US010196122B1

(12) United States Patent
Andrasko et al.

(10) Patent No.: US 10,196,122 B1
(45) Date of Patent: Feb. 5, 2019

(54) STEERING SYSTEM AND METHOD PROVIDING STEERING ALIGNMENT RECOVERY

(71) Applicant: Brunswick Corporation, Lake Forest, IL (US)

(72) Inventors: Steven J. Andrasko, Oshkosh, WI (US); Jason S. Arbuckle, Horicon, WI (US); Kenneth G. Gable, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 79 days.

(21) Appl. No.: 15/387,361

(22) Filed: Dec. 21, 2016

(51) Int. Cl.

| | |
|---|---|
| ***B63H 20/12*** | (2006.01) |
| ***B63H 25/02*** | (2006.01) |
| ***B63H 25/42*** | (2006.01) |
| *B63J 99/00* | (2009.01) |

(52) U.S. Cl.
CPC ..... *B63H 25/02* (2013.01); *B63H 20/12* (2013.01); *B63H 25/42* (2013.01); *B63H 2025/022* (2013.01); *B63J 2099/008* (2013.01)

(58) Field of Classification Search
CPC ..... B63H 25/02; B63H 20/12; B63H 25/42; B63H 2015/022; B63H 2025/022; B63J 2099/008
USPC ..... 701/21
See application file for complete search history.

(56) References Cited

U.S. PATENT DOCUMENTS

| | | | | |
|---|---|---|---|---|
| 4,893,800 | A | 1/1990 | Tabata | |
| 6,273,771 | B1 | 8/2001 | Buckley et al. | |
| 6,322,404 | B1 | 11/2001 | Magee et al. | |
| 6,942,530 | B1 | 9/2005 | Hall et al. | |
| 7,104,857 | B1 | 9/2006 | Swan et al. | |
| 7,267,068 | B2 | 9/2007 | Bradley et al. | |
| 7,398,742 | B1 | 7/2008 | Gonring | |
| 7,727,036 | B1 | 6/2010 | Poorman et al. | |
| 7,941,253 | B1 | 5/2011 | Brant | |
| 8,113,892 | B1 | 2/2012 | Gable et al. | |
| 8,265,830 | B2 | 9/2012 | Mizutani | |
| 9,359,057 | B1 | 6/2016 | Andrasko et al. | |
| 9,809,292 | B1 * | 11/2017 | Gonring | B63H 25/02 |
| 2012/0045951 | A1 | 2/2012 | Washino et al. | |

OTHER PUBLICATIONS

Unpublished U.S. Appl. No. 14/596,606, filed Jan. 14, 2015.
Unpublished U.S. Appl. No. 15/190,620, filed Jun. 23, 2016.

* cited by examiner

*Primary Examiner* — Aaron L Troost
*Assistant Examiner* — Paula L Schneider
(74) *Attorney, Agent, or Firm* — Andrus Intellectual Property Law, LLP

(57) ABSTRACT

A method of operating a steer-by-wire steering system on a marine vessel includes receiving an initial component position of a steerable component and receiving an initial wheel position of a manually rotatable steering wheel with respect to a zero position. An initial normalized steering value is then calculated based on the initial component position, and the initial normalized steering value is correlated to the initial wheel position. The correlation between a subsequently received wheel position and a subsequently calculated normalized steering value is then adjusted by a recovery gain until the steering wheel reaches an aligned position with the steerable component.

20 Claims, 6 Drawing Sheets

STEERING SYSTEM AND METHOD PROVIDING STEERING ALIGNMENT RECOVERY

FIELD

The present disclosure relates to systems and methods for controlling steering of a marine vessel. More specifically, the present disclosure relates to steer-by-wire systems and steering control methods that adjust alignment between a steering device and a steerable component, such as marine propulsion device.

BACKGROUND

The following U.S. Patents and Applications provide background information and are incorporated herein by reference in entirety.

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 7,941,253 discloses a marine propulsion drive-by-wire control system that controls multiple marine engines, each one having one or more PCMs, i.e. propulsion control modules, for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

U.S. Pat. No. 7,727,036 discloses a system and method for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

U.S. Pat. No. 7,104,857 discloses a hydraulically assisted steering system that provides a controller which activates a hydraulic pump when a manual throttle selector handle is in either forward or reverse gear selector positions, but deactivates the pump when the handle is in a neutral gear selector position. A controller can also interrogate an ignition key to make sure that it is in an ON position and also respond to the activation of a manual switch which can be used to override the deactivation step of the pump.

U.S. Pat. No. 6,322,404 discloses a. Hall effect rotational position sensor mounted on a pivotable member of a marine propulsion system and a rotatable portion of the rotational position sensor attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus. The controller is connected in signal communication with each of the plurality of devices on the communication bus. The input and output devices can each transmit messages to the serial communication bus for receipt by other devices.

U.S. application Ser. No. 15/596,606 discloses a method for controlling steering alignment in a marine vessel includes detecting a rotational position of a steering device and detecting a rotational addition of a steerable component, wherein the steerable component is couplable to a marine vessel and steerable to a plurality of positions so as to vary the direction of movement of the marine vessel. The rotational position of the steering device and the rotational position of the steerable component are then compared. The operation between the steering device and the steerable component is then automatically adjusted while the steering device is moved by a user until alignment between the steering device and the steerable component is reached.

U.S. application Ser. No. 15/190,620 discloses a drive-by-wire control system for steering a propulsion device on a marine vessel includes a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of operating a steer-by-wire steering system on a marine vessel includes receiving an initial component position of a steerable component, which may be a previously commanded actuator output or a sensed position of the steerable component, and receiving an initial wheel position of a manually rotatable steering wheel with respect to a zero position. An initial normalized steering value is then calculated based on the initial component position, and the initial normalized steering value is correlated to the initial wheel position. The correlation between a subsequently received wheel position and a subsequently calculated normalized steering value is then adjusted by a recovery gain until the steering wheel reaches an aligned position with the steerable component.

In another embodiment, a method of controlling steering on a marine vessel includes receiving an initial component position of a steerable component and calculating an initial normalized steering value based on the initial component position. An initial wheel position of a manually rotatable steering wheel is detected with respect to a zero position, and an initial offset from an aligned position is calculated based on the initial normalized steering value and the initial wheel position. A subsequent wheel position is received, and then a subsequent normalized steering value is calculated based on the subsequent wheel position multiplied by a normalizing ratio plus a subsequent offset. The subsequent offset is calculated as the previous offset (such as the initial offset) minus an absolute value of a wheel position change multiplied by a recovery gain, where the wheel position change is equal to the subsequent wheel position minus the previous wheel position (such as the initial wheel position). A steering actuator is then controlled based on the subsequent normalized steering value.

One embodiment of a steering system on a marine vessel includes a steerable component, a steering actuator that moves the steerable component about a steering axis, a steering wheel, a steering position sensor that senses a position of the steering wheel, and one or more control modules. The one or more control modules are configured to receive an initial component position of the steerable component and calculate an initial normalized steering value based on the initial component position. The initial wheel position of a manually rotatable steering wheel is received with respect to a zero position, and the initial normalized steering value is correlated to the initial wheel position. Subsequent wheel positions are received, and each subsequent wheel position is correlated to a normalized steering value based on a normalizing ratio and an offset until the steering wheel reaches an aligned position with the steerable component. The steering actuator is controlled based on the normalized steering value.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 2:
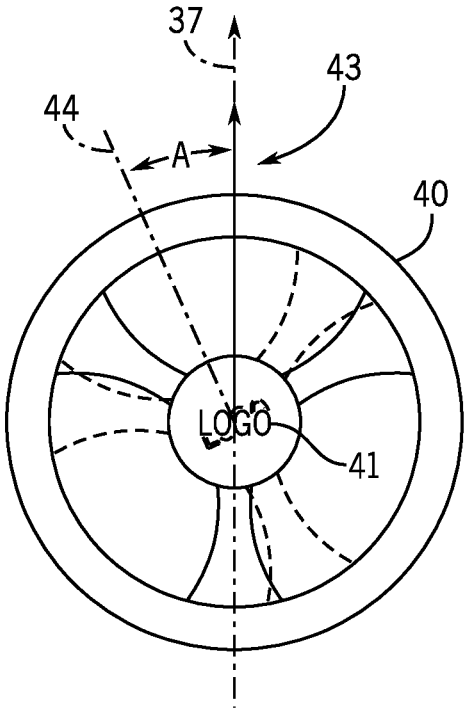
FIG. 2 depicts an exemplary steering wheel in a zero position, and in a turned wheel position with respect to the zero position.

Circumstances arise where a steering device, such as a steering wheel, becomes misaligned from the steerable component, such as a propulsion device of a marine vessel, such that a center position of a steering wheel does not align with a center position of the steerable component, such as an outboard marine drive or other propulsion device. Through analysis, research, and development, the present inventors recognized several problems with prior art systems and methods for aligning a steering wheel on a marine vessel to a steerable component. The present inventors recognized that there is a need to have a centered steering alignment between the steering wheel and the steerable component so that the steering wheel can provide a visual indicator of its orientation to the user. Further, centered alignment permits steering wheels with decals, logos, displays, or controls mounted thereon to be used with maximum ease and effectiveness. For example, a steering wheel, such as that illustrated in FIG. 2, may have a configuration that lends itself to being oriented to a particular centered position. In the example of FIG. 2, the steering wheel 40 has a logo 41 in the center thereof. In its centered position 43, the logo is facing upward and the steering wheel 40 is symmetrical around a vertical center axis 37. When the steering wheel 40 is in alignment with the steerable component, the angle A of the steering wheel 40 correlates to an angle of the steerable component. Thus, a user can determine an approximate position of the steerable component by looking at the position of the steering wheel 40 with respect to the centered position 43. Furthermore, in embodiments having displays or controls on the steering wheel 40, having a steering alignment with the steerable component 16 can be important for the usability of such displays and controls.

Available steering wheel and steering device correction systems are designed to suddenly turn a steering wheel to a prescribed position upon startup or helm transfer. For example, motorized steering actuators are used to motor the steering wheel to a centered position or to an aligned position with the steerable components. However, motorized wheels are lacking in their ability to provide smooth, progressive, and controllable braking torque. Further, motorized steering actuators are large, complicated, cumbersome, expensive, and prone to problems. Accordingly, the inventors recognized a need to enable the use of a non-motorized steering wheel actuator that can provide alignment correction without the use of motorized actuator components to provide motorized movement to the steering wheel.

In other embodiments, the steerable components, such as propulsion devices, are moved into alignment with the steering wheel 40 once the steering wheel becomes active, such as upon startup or upon disabling auto heading or waypoint tracking. For instance, if the wheel is centered upon disabling auto heading, the one or more propulsion devices on the marine vessel would also center. Likewise, if the wheel is turned by 180°, then the drives would move to an appropriate drive angle to match that steering wheel position. For example, if the steering wheel becomes the active by transitioning off of autopilot while the marine vessel 2 is underway, it is undesirable to have a step change in the steering setpoint for the propulsion device because it would impact the vessel heading.

Figure 1:
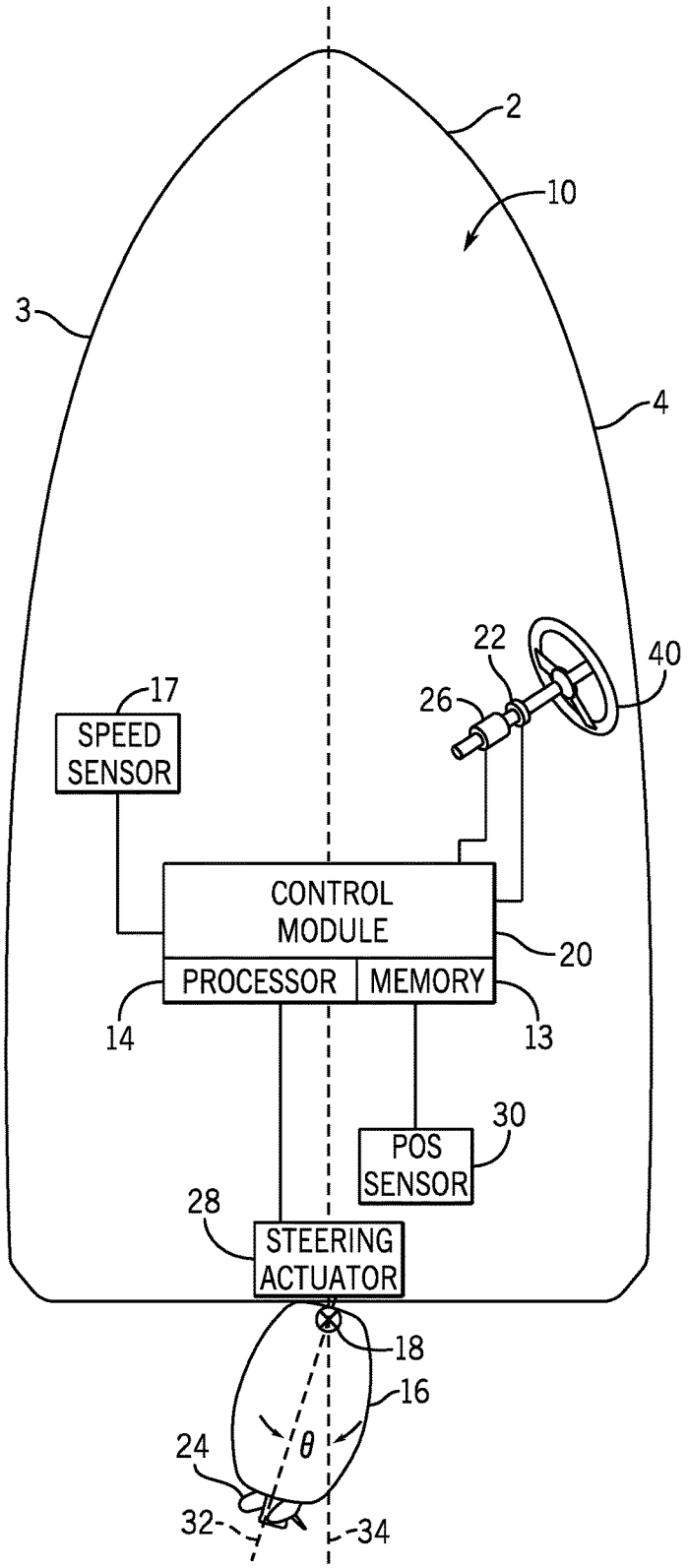
FIG. 1 is a schematic view of one embodiment of a steering system on a marine vessel.

FIG. 1 illustrates a marine vessel 2 having a port side 3 and a starboard side 4. A steerable component 16 is located on the marine vessel 2 and positioned to effectuates a force thereon to control the direction of motion of the vessel, such as a propeller imparting a thrust near a stern of the marine vessel 2. In the example shown, the steerable component 16 is couplable to, or able to be coupled into, the steering system 10 of the marine vessel 2. The steerable component 16 may comprise any of a pod drive, an outboard motor, a stern drive, or a jet drive. Thus, the steerable component 16 may be coupled in torque transmitting relationship with an internal combustion engine via an output shaft. In a stern drive embodiment, for example, the steerable component 16 may include a propeller shaft that connects to a propeller 24. Alternatively, in an outboard embodiment, the steerable component may include the entire outboard, which is rotated about vertical steering axis 18. When torque is transmitted from the internal combustion engine via the shaft to the propeller shaft and the propeller 24, a thrust is produced to propel the marine vessel 2 in a direction that corresponds to a steering position of the steerable component 16. Alternatively, if the marine vessel 2 is provided with an inboard drive, the steerable component 16 may be a rudder.

Figure 3:
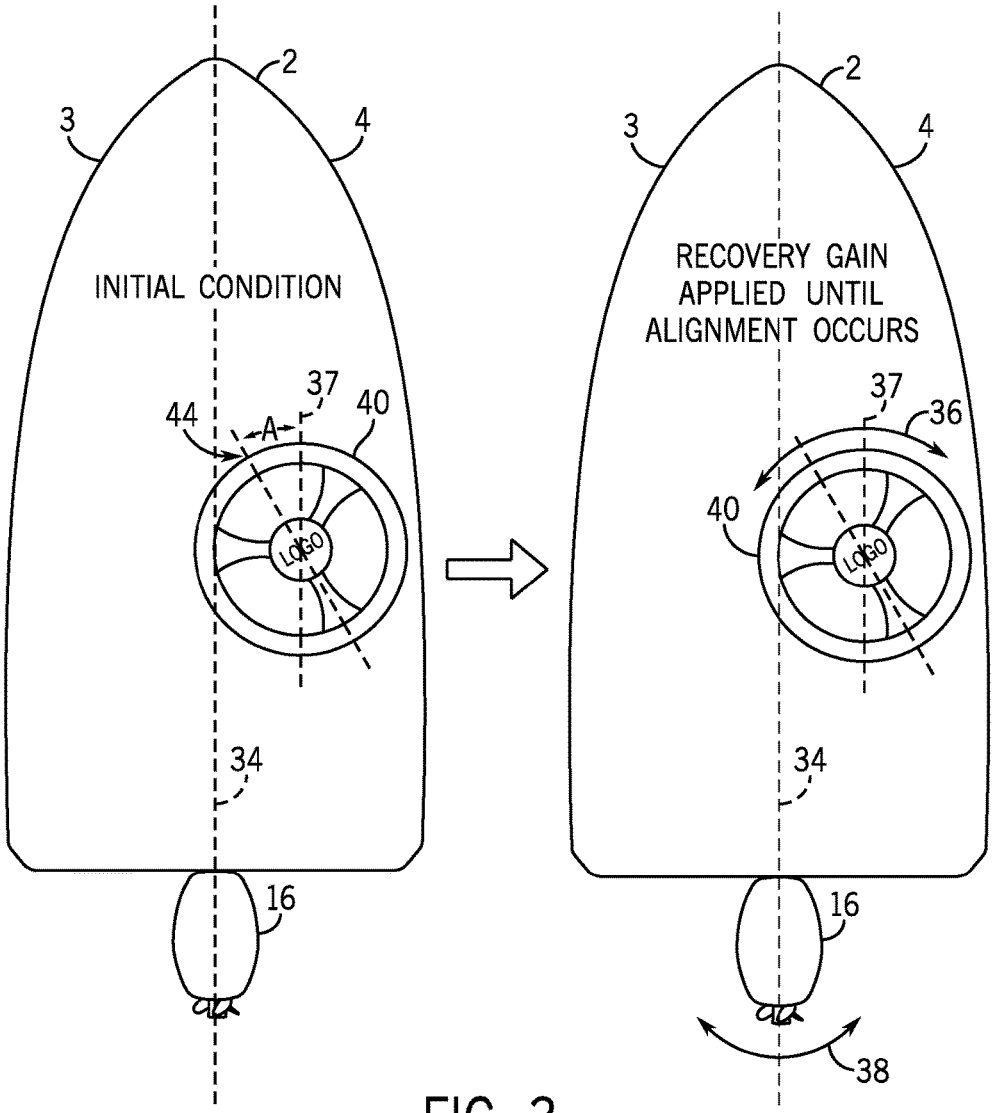
FIG. 3 illustrates one embodiment of a system and method of operating a steer-by-wire steering system to achieve alignment between a steerable component and the steering wheel.

In the example of FIGS. 1 and 3, the steerable component 16 is steerable around a vertical steering axis 18, it being understood that different types of marine vessels and steerable components may have steering axes that are not vertically aligned. The rotation about steering axis 18 is actuated by a steering actuator 28, which actuates the steerable component 16 to one of a plurality of positions so as to control direction of movement of the marine vessel 2. The steering actuator 28 may be, for example, any hydraulic, electric, or electric over hydraulic steering actuator. For example, the steering actuator 28 may be a hydraulic pump that pumps pressurized hydraulic fluid through a control valve to either side of a piston cylinder, as is common and known in the relevant art, to control movement of the steerable components 16. A position sensor 30 is located on or associated with the steering actuator 28 or the steerable component 16 to sense a steering position or steering angle of the steerable component 16, referred to herein as the component position. The component position may be, for example, a distance or an angle between a center axis 32 of the steerable component 16 from the center line 34 of the marine vessel 2 (or a line parallel thereto, if the steering system 10 includes multiple propulsion devices), which is depicted as angle θ in FIG. 1.

This type of digitally-controlled steering arrangement is commonly referred to in the art as a "steer-by-wire" system, wherein there is no direct mechanical connection between the steering wheel 40 and the steering actuator 28 or the steerable component 16, but such control is provided by one or more control modules 20, 21 receiving inputs from the various components in the steering system 10 and controlling the steering actuator 28 accordingly. For example, such communication between the various components within the system 10 may be provided on a communication bus, such as on a controller area network (CAN) bus. In other embodiments, however, any type of wired or wireless communication may be provided between the various devices. In the embodiment depicted in FIG. 1, the communication link lines are meant only to demonstrate that the various elements are capable of communicating to or between one another and do not represent actual wiring connections between the various elements, nor do they represent the only paths of communication between the elements.

In one embodiment, a certain rotation of the steering wheel 40 gets related to an amount of rotation of the steerable component 16, and such relation is generally provided by one or more drive angle maps stored in memory of one or more control modules within the steering system 10. In certain embodiments, the relation between the angle of the steering wheel 40 and the angle of the steerable component 16 may vary for a particular marine vessel depending on vessel conditions, such as vessel speed, engine speed, engine load, or the like. Each of the one or more drive angle maps may associate a sensed position of the steering wheel 40 with a particular position of the steerable component 16, which may also be a particular position of the steering actuator 28. For example, the position of the steering wheel 40 may be sensed by a position sensor 22 associated with the steering wheel, which may be, for example, an encoder or transducer or other type of position sensor, many of which are conventional for such applications. In other embodiments, the position of the steerable component may be correlated with a normalized steering value. In certain embodiments, the steering wheel position is normalized, such as to a scale between −100% and 100%, and the movement of the steerable component 16 is correlated to that normalized steering value. This allows for flexible steering implementation, where the range of possible component position angles can be adjusted independently of the correlation with sensed positions of the steering wheel 40. For example, the steering system 10 may be configured to provide a wider range of component positions (e.g. drive angles of an outboard motor) at lower vessel speeds, and then restrict the possible range of component positions as the vessel speed increases. Likewise, where a steering misalignment as occurred, the sensed positions of the steering wheel 40 (e.g., the position sensed by position sensor 22 with respect to a centered position 43) can be correlated to the normalized steering position based on an alignment with the position of the steerable component 16, as is described in detail herein.

Accordingly, one or more control modules 20 within the steering system 10 are configured to receive the steering wheel position measurement from the position sensor 22 and to determine a corresponding component position for the steerable component 16 based thereon. Additionally, the component position may be based on other inputs from elements within the system 10. For example, the control module(s) may receive a vessel speed from a speed sensor 17 that measures speed of travel of the marine vessel 2, and may further correlate the wheel position to the component position based thereon. The speed sensor 17 may be any device capable of measuring or determining the speed of the marine vessel 2, and in exemplary embodiments may include a pitot tube, a paddle wheel, or a global positioning system (GPS)-based speed determination system. Alternatively or additionally, the relation between the steering input provided at the steering wheel 40 and the steering position of the steerable component 16 may further be controlled based on engine speed or engine load of an engine within one or more propulsion device(s) of the marine vessel 2.

The steering system 10 includes one or more control modules that provide the control function and methods described herein for controlling position of the steerable component 16 based on inputs provided at the steering wheel 40. In the depicted embodiment, a central control module 20 receives inputs regarding wheel position of the steering wheel 40 from the position sensor 22 and receives inputs regarding the component position of the steerable component 16 from position sensor 30. In the depicted embodiment, the control module 20 also receives input from speed sensor 17.

The control module 20 then controls steering of the steerable component 16 by sending control signals to the steering actuator 28 causing it to move the steerable component 16 to the desired steering position. In various embodiments, the steering system 10 may include one or more control modules that perform various aspects of the disclosed method. For example, the steering control logic may be split between a helm module providing central control of various aspects of the marine vessel, and other control modules, such as a CAN-based control module associated with the steering wheel. Thus, although the control module 20 is represented in the depicted embodiment as a single control module including memory 13 and a programmable processor 14, the control module 20 may actually be embodied as multiple different control modules. For instance, the steering system 10 may incorporate a central control module, such as a helm control module, and a CAN-based steering wheel control module communicatively connected to the central control module, wherein both modules cooperate to provide the control functions described herein. In other embodiments, some or all of the control functions described herein may be performed by one or more CAN-based or other control modules associated with the steering wheel 40 and/or the steering actuator 28, with no input from a central control module, such as a helm control module.

The systems and methods described herein may be implemented with one or more computer programs executed by one or more processors, which may all operate as part of a single control module 20 or as separate control modules as described above. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

As used herein, the term control module may refer to, be part of, or include an application-specific integrated circuit (ASIC), an electronic circuit, a combinational logic circuit, a field programmable gate array (FPGA), a processor (shared, dedicated, or group) that executes code, or other suitable components that provide the described functionality, or a combination of some or all of the above, such as in a system-on-chip. The term control module may include memory (shared, dedicated, or group) that stores code executed by the processor. The term code, as used herein, may include software, firmware, and/or microcode, and may refer to programs, routines, functions, classes, and/or objects. The term shared, as used above, means that some or all code from multiple control modules may be executed using a single (shared) processor. In addition, some or all code to be executed by multiple different processors may be stored by a single (shared) memory. The term group, as used above, means that some or all code comprising part of a single control module may be executed using a group of processors. Likewise, some or all code comprising a single control module may be stored using a group of memories.

It will be understood by a person having ordinary skill in the art in view of this disclosure that the principles discussed herein with reference to a single steerable component 16 are equally applicable to two or more steerable components 16 on a marine vessel, such as two or more propulsion devices or two or more rudders, and the number of steerable components 16 is not limiting on the scope of the present disclosure.

As described above, a situation may occur where the position of the steering wheel 40 is not in alignment with the position of the steerable component 16. For example, such misalignment may occur where a control element other than the steering wheel 40 was controlling position of the steerable component 16. In various embodiments, other steering control elements may include a joystick, an automatic heading or position control system, or the steering wheel of another helm (i.e. in a marine vessel having two helms). In an embodiment where the wheel has a single possible aligned position, such as that depicted in FIG. 2, the maximum misalignment between the wheel position and the component position is 180°. In another embodiment where the wheel is symmetrical about its horizontal center, the wheel could have two possible aligned positions, and thus the maximum misalignment between the wheel position and the component position would be 90°. Additionally, misalignment may occur where an operator turns the steering wheel 40 past an end stop. In some embodiments, when a wheel is moved past an end stop, interpretation of the steering input provided by the steering wheel is adjusted so that the user is not required to move the wheel back past the end stop in order to provide steering inputs. In other words, even when the wheel is moved past an end stop in a particular position, movement of the wheel in the opposite direction (back towards the end stop) will be translated into movement of the steerable component 16. Thus a steering misalignment is created.

The end stop is generally the furthest point in a particular rotation to which the steering wheel is permitted to rotate. In steer-by-wire systems, these end stops are digitally set and activated by a resistance device 26, which apply a braking force on the wheel to prevent or discourage turning the wheel past the point of the end stop. The resistance device 26 is operable to apply a resistance force to resist rotation of the steering wheel 40, such as by applying the resistance force to the steering column. The type of resistance device 26 can vary and can include any type of electrical, mechanical and/or hydraulic device that is operable to variably resist (i.e. restrict and/or brake) rotational movement of the steering wheel 40 based upon commands from the control module 20. For example the resistance device 26 may include an electric motor and/or a hydraulic pump that powers a mechanical clamp or other similar device that engages with the steering column attached to the steering wheel 40 and applies variable resistance force on the steering column to restrict, resist, or brake its rotation. This is just one example and the type of resistance device 26 can vary. In other examples, the resistance device 26 may include 1) a DC motor directly coupled to the steering column capable of braking via short circuit and/or back-driving via H-bridge, 2) a hydraulic circuit with pump directly attached to the steering wheel and a controlled orifice to restrict rotational movement of the steering column, 3) a clutch brake mechanism attached to the steering column with a braking force applied to the clutch via a controlled solenoid, 4) a magneto-rheological fluid (MRF) braking mechanism attached to steering column and capable of applying a variable braking force thereon.

As described above, an immediate change in the position of the steering wheel 40 or the steerable component 16 in order to bring the devices into alignment may cause an uncomfortable or even dangerous situation for the user, which is undesirable. In view of their recognition of the forgoing problems and challenges with the prior art, and in view of the recognition of the above-described value of having centered steering alignment—i.e., where a centered position 43 of the steering wheel 40 corresponds with a centered position of the steerable component 16—the present disclosure provides a system and method whereby alignment can be gradually corrected during the course of steering operation by a user. When a misalignment is detected, gradual correction is provided during the steering process so that the steering wheel 40 can be brought into centered alignment with the steerable component 16 without any abrupt changes to the steering system and in a way that is minimally noticeable to the user. Thus, the system 10 adjusts the operation between the steering wheel 40 and the steerable component 16 during the course of regular operation of a user steering the marine vessel 2 until such time as alignment is reached.

Specifically, upon detection of a misalignment, a correlation between movement of the steering wheel 40 and the steerable component 16 is adjusted or changed to require relatively more movement of the steering wheel 40 in one rotational direction than in an opposite rotational direction, where more movement of the steering wheel 40 is required per degree angle change of the steerable component 16 in the direction toward which correction is desired. FIG. 3 provides an illustrative example of the general idea. In an initial condition, the wheel position of the steering wheel 40 is at a turned position 44, at angle A with respect to the vertical center axis 37, while the steerable component 16 (here, an outboard motor) is in the centered position aligned with the center line 34 of the marine vessel 2. Thus, misalignment has occurred between the steering wheel 40 and the steerable component 16. This misalignment is detected and the control module 20 then effectuates an algorithm to correct the misalignment, where correlation between the changing wheel positions and the effectuated movement of the steerable component 16 is adjusted by a recovery gain amount applied oppositely in each steering direction until alignment occurs.

As depicted in the example of FIG. 3, the steering wheel 40 is misaligned from the steerable component 16 toward the port side 3 of the marine vessel 2. Thus, an alignment adjustment needs to be made to move the steering wheel 40 toward the starboard side 4 relative to the position of the steerable component 16. In other words, movement of the steering wheel 40 needs to be made toward the starboard side 4 without corresponding relative movement, or as much relative movement, of the steerable component 16 toward the starboard side 4. The recovery gain is applied so that an increased amount of movement is required by the steering wheel 40 toward the starboard side 4 relative to the amount of movement effectuated at the steerable component 16. Similarly, the recovery gain can be applied oppositely when the steering wheel 40 is turned toward the port side 3, where the steering is made relatively more sensitive so that less movement of the steering wheel 40 is required to effectuate movement of the steerable component 16. Thus, gains are made toward reaching alignment when the steering wheel 40 is moved in either direction. The concept is illustrated by the arrows 36 and 38, where a relatively larger movement of the steering wheel 40 toward the starboard side 4 (arrow 36) effectuates the same movement in the steerable component 16 (arrow 38) as a relatively smaller magnitude of steering wheel 40 movement required toward the port side 3, in order to effectuate the same magnitude of change in the steerable component 16. The arrows 36 and 38 are simply for illustration of the concept and are not meant to be a scaled representation.

Accordingly, gradual steering alignment is achieved without disrupting the user's driving experience. Preferably this transition is gradual enough so that the user does not experience discomfort when operating the steering wheel 40. The aggressiveness of the transition is governed by the value of the recovery gain, which is a parameter equal to how much alignment change (i.e. alignment "recovery") is made per 360° turn of the wheel. Thus, the units of the recovery gain are normalized steering amount (e.g., normalized steering percent) per full wheel turn. The recovery gain may be set to any value, which may be optimized for a particular vessel configuration. Additionally, in some embodiments the recovery gain value may be adjusted by the control module 20 in response to different conditions of the marine vessel 2, such as vessel speed, engine speed, engine load, or the like. In general, the recovery gain may be optimized to provide steering alignment correction as quickly as possible without causing user discomfort or compromising safety.

Figure 4:
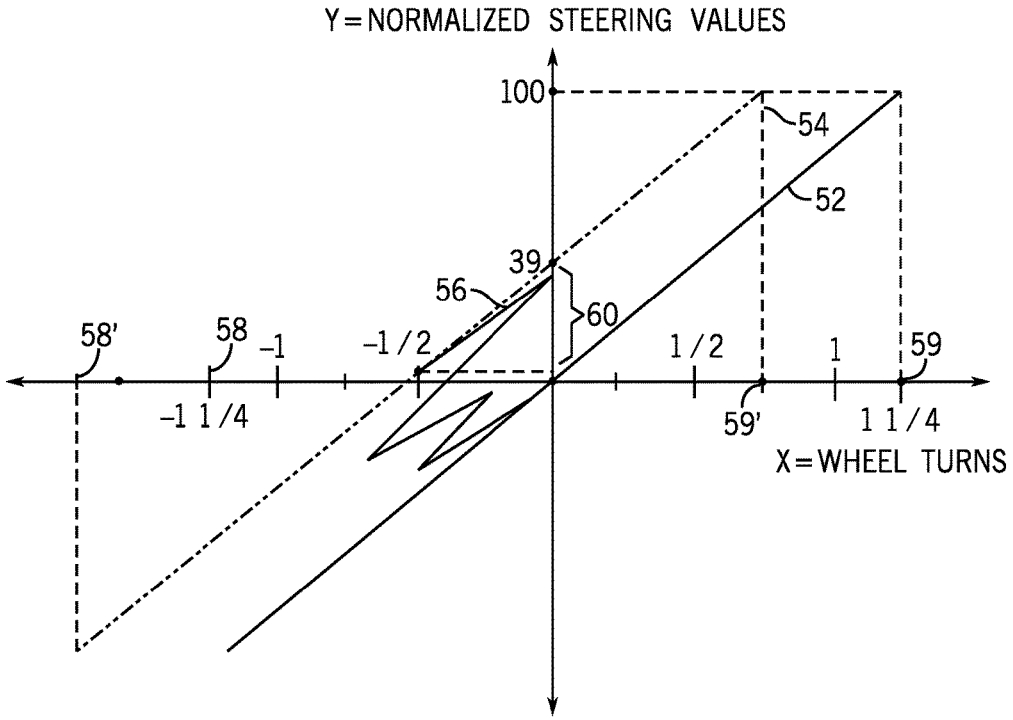
FIG. 4 is a graph comparing wheel turns, or change in wheel position, to normalized steering values, which illustrates on embodiment of a method of operating a steer-by-wire steering system to achieve alignment between a steerable component and the steering wheel.

FIG. 4 provides a graphical depiction of an example where the steering wheel 40 is misaligned toward the port side 3 direction with respect to the steerable component 16. FIG. 4 provides an example graph of normalized steering values (expressed as −100% to +100% along the Y axis, or a −1 to 1 decimal) versus wheel position with respect to the centered position (expressed as turns away from zero in the positive clockwise and negative counterclockwise directions). Line 52 represents a set of aligned position control values—i.e., there is no misalignment between the steering wheel 40 and the steerable component 16. In the equation for the straight line 52, Y=Mx+B, where the y intercept (B) equals zero. The slope value (M) is the normalizing ratio, which is equal to two (or 200%) divided by the number of turns between the end stops in both directions—i.e., the total amount of times that the wheel turns in rotating between the port side end stop 58 and the starboard side end stop 59. In the depicted embodiment, the number of full wheel turns between the end stops 58 and 59 is 2.5 wheel turns, and thus the normalizing ratio is 2/2.5.

In the example depicted in the graph of FIG. 4, a misalignment is detected when the control module receives a component position of the steerable component 16 and compares it to the wheel position to determine that the point associated with the component position and the wheel position are not on the line 52 representing the aligned position control values. Accordingly, the component position must be correlated to the wheel position to determine an initial correlation value. An offset is also calculated which is the amount of steering wheel position that will be recovered in order to bring the steering wheel 40 into alignment. The initial correlated position is represented by line 54, which is shifted by an initial value 60 from the line 52 representing the aligned position. In the depicted example, the initial normalized steering value associated with the initial component position at the time the misalignment is detected is +3%, and the initial wheel position is −0.45 turns. The equation given for determining the line 54 representing the initial correlation is:

$$Yo=(2/WT)Xo+Bo$$

Where $Y_o$ is the initial normalized steering value, $W_T$ is the turn range from end stop to end stop, $X_o$ is the measured initial wheel position, and $B_o$ is the Y-intercept, which is equal to the difference between the correlated values of line 54 and the aligned values represented by line 52. Accordingly, applying the initial normalized steering value of 3% and the initial wheel position value of −0.45, an initial value $B_o$ is calculated as 39%. In certain embodiments, the offset is determined so that it does not exceed 180 degrees (+/−0.5 wheel turn). Thus, in a scenario where the difference between the correlated values of line 54 and the aligned values represented by line 52 exceeds 180 degrees of wheel turn, the offset value may be adjusted to provide the shortest path to alignment. For example, if the difference between the correlated values of line 54 and the aligned values represented by line 52 is −315 degrees, or −0.75 wheel turns, the offset may be set to +0.25 wheel turns (meaning that the aligned position is determined to be the nearest point where the steering wheel 40 can be aligned, e.g., in a centered position 43 when the steerable component is in the straight ahead position.

The correlation between subsequently received wheel positions and subsequently calculated normalized steering values may then be adjusted by applying a recovery gain as the steering wheel 40 moves until the steering wheel 40 reaches an aligned position with the steerable component 16. An exemplary alignment process is represented at line 56. As explained above, the units of the recovery gain are normalized steering % per wheel turn—i.e., Y-axis units over X-axis units. The intent is that for every turn of the wheel, whether it be in the port direction or the starboard direction, the value of the offset B will decrease by the recovery gain percent. Thus, the misalignment between the steering wheel 40 and the steerable component 16 is blended out as the wheel is moved, whether the wheel is turned in a positive or negative direction. The offset is decreased as the wheel turns. The offset can be calculated by the following equation:

$$B_n = B_{n-1} - |X_{n-1} - X_n| \cdot G_R$$

Where $B_n$ is the offset value for the current calculation, and $B_{n-1}$ is the immediately previous offset calculation. Accordingly, the offset is adjusted by a change in the wheel turns since the last offset calculation multiplied by the recovery gain $G_R$. The subsequent normalized steering value $Y_n$ can then be calculated by the following equation:

$$Y_n = \left(\frac{2}{W_T}\right) X_n + B_n$$

Applying this to the alignment process represented by line 56 in FIG. 4, the offset decreases as the wheel turns. Specifically, the steering wheel 40 is moved by +0.5 turns, then −0.7 turns, then +0.4 turns, then −0.25 turns, then +0.6 turns. At this time, the offset has been completely blended out in 2.45 cumulative wheel turns. This number makes logical sense, in that the initial offset of 39% divided by the recovery gain value of 16% yields 2.45.

The adjusted normalized wheel percent values are then used to calculate the desired component position for the steerable component, and then the steering actuator 28 is instructed to move the steerable component 16 to the desired component position. For example, the desired component position may be calculated by multiplying a magnitude of the drive angle range between zero and a maximum drive angle by the normalized wheel percent. Thus, if the normalized wheel percent is 50% and the magnitude of the drive angle range from the centered position is 26°, then the desired component position may be calculated as 50% of 26°, or 13° from the centered position.

In certain embodiments, the end stops 58 and 59 may be adjusted as the alignment correlation shifts. Initially, the end stop positions may be adjusted to align with the initial correlated values of line 54 so that the full range of steering input can be provided. Thus, initial end stop positions 58' and 59' may be calculated for the initial correlation represented at line 54 based on the initial offset. As the correlation between the wheel position and the normalized steering value is adjusted to bring the steering wheel 40 into alignment with the steerable component 16, the end stop positions may be adjusted accordingly so that a full range of steering positions are always available in each rotational direction. For example, the end stop positions may be adjusted by an amount equal to a change in the offset divided by the normalizing ratio, which is provided by the following equation:

$$\Delta X_E = (B_{n-1} - B_n)\left(\frac{W_T}{2}\right)$$

Where $\Delta X_E$ equals the change in end stop position, which would be applied equally to shift both end stop positions (e.g., 58 and 59, or 58' and 59') in the same direction according to the change in the offset value B.

Figure 5A:
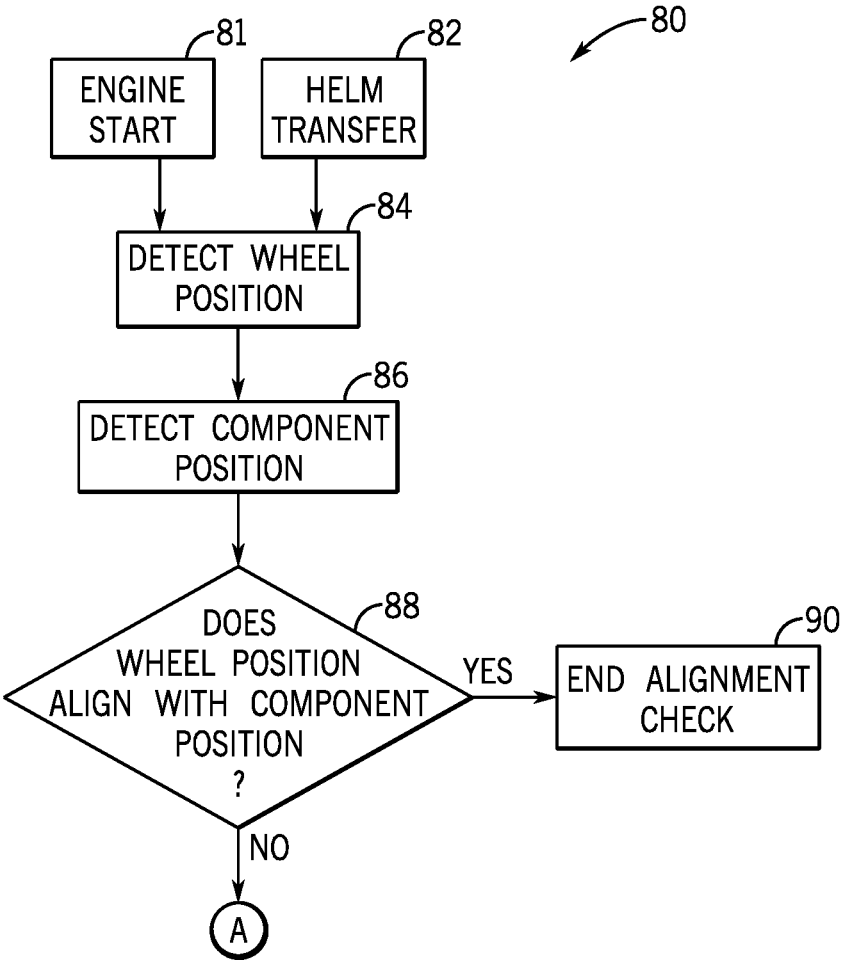
FIGS. 5A and 5B are flow charts depicting one embodiment of a method of operating a steer-by-wire steering system on a marine vessel.

FIG. 5 depicts an exemplary embodiment of a method 80 of operating a steer-by-wire steering system on a marine vessel to provide correction of a steering misalignment as described herein. In the depicted example, an alignment check is initiated upon engine startup, represented by step 81, or at helm transfer where control is transferred to the steering wheel 40, represented at step 82. A wheel position is detected at step 84, such as by position sensor 22 associated with the steering wheel 40. In certain embodiments, a component position is also detected at step 86, such as by a position sensor 30 associated with the steering actuator 28. Alternatively or additionally, the control module 20 may take its previously commanded actuator output as the component position for the offset calculation. For example, where wheel is becoming the active setpoint source from another previous setpoint source (joystick, autopilot, other helm, etc.), the commanded actuator output can be used and the steering actuator position is not needed. Instructions are then executed at step 88 to determine whether the wheel position aligns with the component position. If it does, then the steering wheel 40 and the steerable component 16 are in alignment and the alignment check can be terminated at step 90.

Figure 5B:
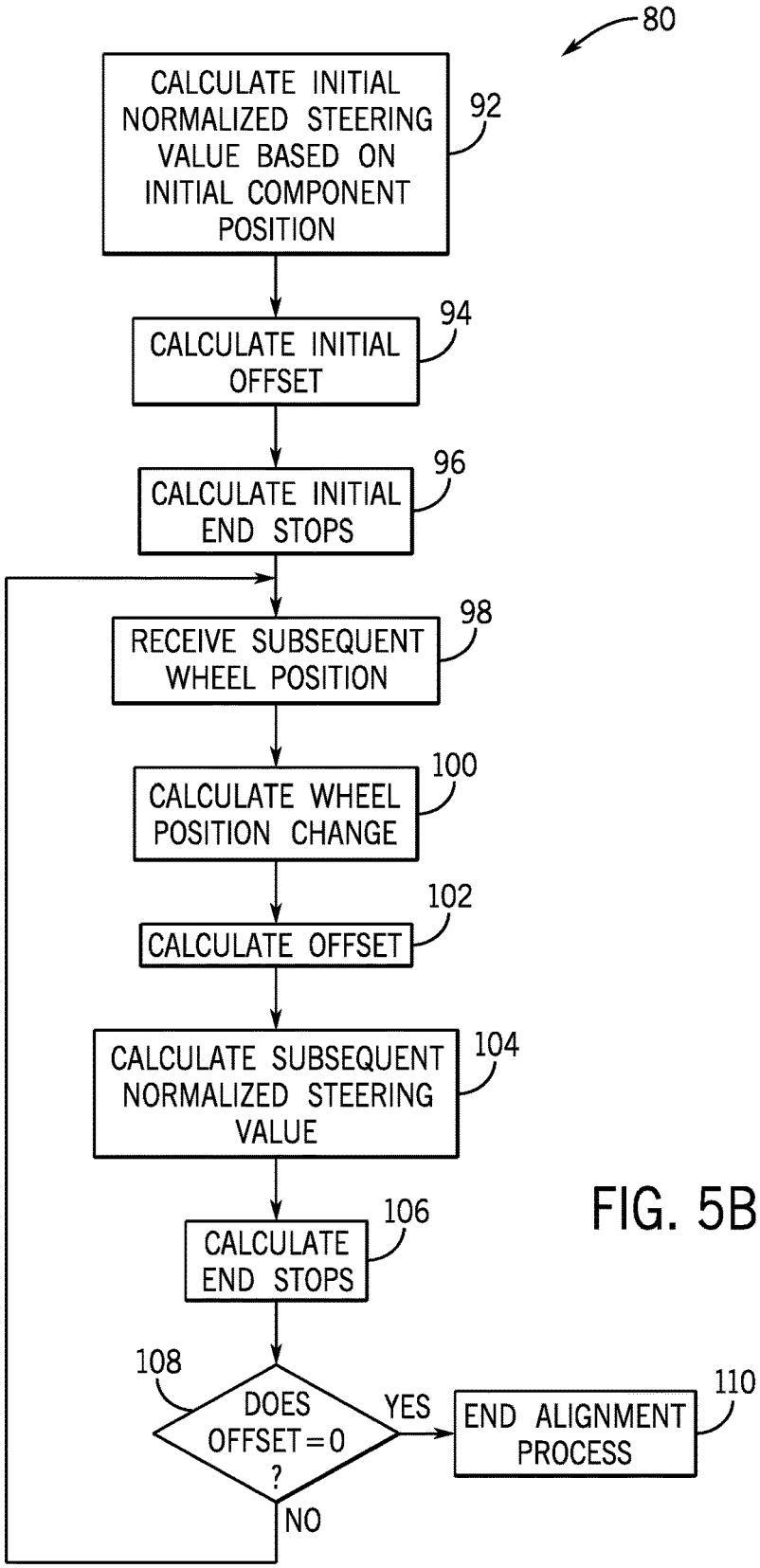

However, if the wheel position and the component position (or last steering actuator command output) are not aligned, then instructions are executed, such as by control module 20, to adjust the correlation between subsequently received wheel positions and the normalized steering values calculated based thereon. FIG. 5B depicts one embodiment of a portion of the method 80 for providing such correlation adjustment in order to move the steering wheel 40 into an aligned position with the steerable component 16. Instructions are executed at step 92 to calculate an initial normalized steering value based on the initial component position received at step 86. An initial offset is then calculated based on the initial normalized steering value and the initial wheel position. An example of such calculation is described above with respect to FIG. 4. Initial end stops are then calculated at step 96 to adjust the position at which the end stops are effectuated, such as by the resistance device 26.

The correlation is then adjusted as subsequent wheel positions are received until the steering wheel reaches alignment with the steerable component 16, such as aligned with the setpoint for the steerable component 16. A subsequent wheel position is received at step 98, such as from position sensor 22 associated with the steering wheel 40. A wheel position change is calculated at step 100 as the subsequent wheel position minus the initial wheel position. The offset is then calculated at step 102, such as according to the equation above. A subsequent normalized steering value is then calculated at step 104 based on the subsequent wheel position, the normalizing ratio, and the offset. New end stop locations are then calculated at step 106 to adjust the end stops accordingly. Instructions are executed at step 108 to determine whether the offset is equal to zero. If so, then alignment between the steering wheel 40 and the steerable component 16 (e.g., the alignment with the set-point therefor) has been reached, and the alignment process is ended at step 110. If the offset has not yet reached zero, then the instructions represented at steps 98-106 are repeated, such as at a control cycle period of 5 milliseconds, until the offset equals zero, or is below a predetermined threshold that is very close to zero.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of operating a steer-by-wire steering system on a marine vessel, the method comprising:

receiving an initial component position of a steerable component;

receiving an initial wheel position of a manually rotatable steering wheel with respect to a zero position;

calculating an initial normalized steering value based on the initial component position;

correlating the initial normalized steering value to the initial wheel position;

adjusting the correlation between subsequently received wheel positions and subsequently calculated normalized steering values by a recovery gain until the steering wheel reaches an aligned position with the steerable component; and controlling a steering actuator to move the steerable component based on the adjusted correlation.

2. The method of claim 1, wherein adjusting the correlation between the subsequently received wheel positions and subsequently calculated normalized steering values includes:

correlating each subsequent wheel position to a normalized steering value based on a normalizing ratio and an offset; and decreasing the offset based on the recovery gain until the offset equals zero.

3. The method of claim 2, further comprising:

determining initial end stop positions for the steering wheel based on an initial offset; and adjusting the initial end stop positions for the steering wheel based on a change in the offset.

4. The method of claim 2, wherein the offset has a maximum possible value of 180 degrees.

5. The method of claim 1, further comprising:

calculating an initial offset from the aligned position based on the initial normalized steering position and the initial wheel position;

receiving a subsequent wheel position; and calculating a subsequent normalized steering value based on the subsequent wheel position, the initial offset, and the recovery gain.

6. The method of claim 5, further comprising:

calculating a wheel position change as the subsequent wheel position minus the initial wheel position;

wherein the subsequent normalized steering value is calculated as the subsequent wheel position multiplied by a normalizing ratio, plus the initial offset, minus the recovery gain multiplied by the absolute value of the wheel position change.

7. The method of claim 6, wherein the offset is reduced in calculating subsequent normalized steering values until the offset equals zero.

8. The method of claim 7, further comprising further comprising:

determining initial end stop positions for the steering wheel based on the initial offset;

adjusting the initial end stop positions for the steering wheel by an amount equal to a change in the offset divided by the normalizing ratio.

9. The method of claim 1, further comprising:

calculating a desired component position based on each of the normalized steering values; and controlling the steering actuator to move the steerable component to the desired component positions.

10. The method of claim 9, wherein each of the desired component positions are calculated by multiplying a drive angle range by a respective one of the normalized steering values.

11. The method of claim 10, wherein the drive angle range is determined based on a vessel speed.

12. A steering system on a marine vessel, the steering system comprising:

a steerable component;

a steering actuator that moves the steerable component about a steering axis;

a steering wheel;

a steering position sensor that senses a position of the steering wheel;

one or more control modules configured to:

receive an initial component position of the steerable component;

calculate an initial normalized steering value based on the initial component position;

receive an initial wheel position of a manually rotatable steering wheel with respect to a zero position;

correlate the initial normalized steering value to the initial wheel position;

receive subsequent wheel positions and correlate each subsequent wheel position to a normalized steering value based on a normalizing ratio and an offset until the steering wheel reaches an aligned position with the steerable component; and wherein the steering actuator is controlled based on the normalized steering value.

13. The steering system of claim 12, wherein the control module is further configured to:

determine initial end stop positions for the steering wheel based on the initial wheel position;

adjust the initial end stop positions for the steering wheel based on a change in the offset; and control a resistance device associated with the steering wheel to apply a force to resist rotation of the steering wheel when the steering wheel reaches either of the end stop positions.

14. The steering system of claim 12, wherein the offset has a maximum possible value of 180 degrees.

15. The steering system of claim 12, wherein the control module is further configured to:

calculate an initial offset from the aligned position based on the initial normalized steering value and the initial wheel position;

receive a subsequent wheel position; and calculate a subsequent normalized steering value based on the subsequent wheel position, the initial offset, and the recovery gain.

16. The steering system of claim 15, wherein the control module is further configured to:

wherein the subsequent normalized steering value is calculated as the subsequent wheel position multiplied by a normalizing ratio plus the initial offset minus the recovery gain multiplied by the absolute value of a wheel position change, wherein the wheel position change is the subsequent wheel position minus the initial wheel position.

17. The steering system of claim 12, wherein the control module is further configured to reduce the offset subsequent normalized steering value calculations until the offset equals zero.

18. The steering system of claim 12, wherein the steerable component is a propulsion device on the marine vessel.

19. A method of controlling steering on a marine vessel, the method comprising:

receiving an initial component position of a steerable component;

calculating an initial normalized steering value based on the initial component position;

detecting an initial wheel position of a manually rotatable steering wheel with respect to a zero position;

calculating an initial offset from an aligned position based on the initial normalized steering value and the initial wheel position;

receiving a subsequent wheel position;

calculating a subsequent normalized steering value based on the subsequent wheel position multiplied by a normalizing ratio plus the initial offset minus a recovery gain multiplied by the absolute value of a wheel position change, wherein the wheel position change is the subsequent wheel position minus the initial wheel position; and controlling a steering actuator based on the subsequent normalized steering value.

20. The method of claim 19, further comprising:

calculating a desired component position based on the subsequent normalized steering value; and controlling a steering actuator to move the steerable component to the desired component position.

* * * * *